US008096001B2

(12) United States Patent
Stimpson

(10) Patent No.: US 8,096,001 B2
(45) Date of Patent: Jan. 17, 2012

(54) PUMPED DRAINAGE APPARATUS

(75) Inventor: Robert William Stimpson, Douglas (GB)

(73) Assignee: DLP Limited, Isle of Man (GB)

( * ) Notice: Subject to any disclaimer, the term of this patent is extended or adjusted under 35 U.S.C. 154(b) by 1126 days.

(21) Appl. No.: 11/817,700

(22) PCT Filed: Mar. 13, 2006

(86) PCT No.: PCT/GB2006/000880

§ 371 (c)(1),
(2), (4) Date: Sep. 4, 2007

(87) PCT Pub. No.: WO2006/100433

PCT Pub. Date: Sep. 28, 2006

(65) Prior Publication Data

US 2008/0219856 A1 Sep. 11, 2008

(30) Foreign Application Priority Data

Mar. 23, 2005 (GB) ..... 0505921.7

(51) Int. Cl.
*E03C 1/00* (2006.01)

(52) U.S. Cl. ..... 4/653; 417/36

(58) Field of Classification Search ..... 417/20, 417/36; 4/653, 665

See application file for complete search history.

(56) References Cited

U.S. PATENT DOCUMENTS

| | | | | |
|---|---|---|---|---|
| 2,440,594 | A * | 4/1948 | Rice | 417/40 |
| 4,032,259 | A * | 6/1977 | Brown | 417/43 |
| 4,853,984 | A * | 8/1989 | Celiano | 4/496 |
| 5,106,493 | A | 4/1992 | McIntosh | |
| 6,045,331 | A | 4/2000 | Gehm et al. | |
| 6,390,999 | B1 * | 5/2002 | Zscheile et al. | 604/4.01 |
| 2003/0159978 | A1 * | 8/2003 | Self et al. | 210/163 |

FOREIGN PATENT DOCUMENTS

| | | |
|---|---|---|
| DE | 10246017 | 4/2004 |
| DE | 10246017 A1 | 4/2004 |
| EP | 0620331 | 10/1994 |
| EP | 1243709 | 5/2001 |
| EP | 1243709 A2 | 9/2002 |
| GB | 1532953 | 9/1974 |

(Continued)

OTHER PUBLICATIONS

International Search Report for PCT/GB2006/000880, Sep. 2005.

(Continued)

*Primary Examiner* — Devon C Kramer

*Assistant Examiner* — Peter J Bertheaud

(74) *Attorney, Agent, or Firm* — Martin Fleit; Paul D. Bianco; Fleit Gibbons Gutman Bongini & Blanco PL

(57) ABSTRACT

A pumped drainage apparatus for a shower includes a waste water unit, a waste water inlet for accepting waste water runoff from a shower, a waste water outlet in fluid communication with the waste water inlet, a pump in fluid communication with the waste water unit, a sensing circuit including one or more sensors for sensing waste water, and a control circuit for controlling and varying a flow rate of the pump based on an output of the sensing circuit. The sensors may be isolated to prevent contact with waste water while the apparatus is in use. A variable flow control device for the pumped drainage apparatus is also provided.

10 Claims, 11 Drawing Sheets

FOREIGN PATENT DOCUMENTS

| | | | |
|---|---|---|---|
| GB | 1532953 | A | 11/1978 |
| GB | 2224777 | | 10/1989 |
| GB | 2294636 | | 11/1994 |
| GB | 2310374 | | 11/1994 |
| GB | 2294636 | A | 5/1996 |
| GB | 2294636 | * | 8/1996 |
| GB | 2361419 | | 3/2001 |
| GB | 2373515 | | 6/2003 |
| JP | 54148982 | A | 11/1979 |
| JP | 5141686 | | 6/1993 |
| JP | 2001041190 | | 2/2001 |

OTHER PUBLICATIONS

International Preliminary Report on Patentability for PCT/GB2006/000880, Sep. 2005.

British Search Report for GB 0505921.7, Jun. 7, 2005.

Examination Report from the European Office for GB Application No. 06726373.1 issued Feb. 9, 2011.

* cited by examiner

PUMPED DRAINAGE APPARATUS

FIELD OF THE INVENTION

The present invention relates to pumped drainage apparatus and, more particularly, to a variable flow control device for such apparatus.

BACKGROUND OF THE INVENTION

It is known to provide an electrically operated pump in fluid communication with a waste water unit of a shower for drawing waste water from the unit to a drain. The use of a pump is particularly beneficial when there is little space below the shower floor surface such as with an unbreachable solid screened floor or between joists and under floorboards to allow for a waste water unit with a trap to be fitted. The omission of a trap results in the possibility of undesirable odours backflowing into the shower area. Consequently, the pump acts to draw odours, as well as waste water, away from the shower area.

The pump is also beneficial in increasing discharge flow rate where smaller diameter pipe work is used in the drainage apparatus. This helps prevent flooding in the shower area.

However, intrusive operational noise is a problem associated with the utilisation of a pump.

The present invention seeks to provide a solution to this problem.

SUMMARY OF THE INVENTION

According to a first aspect of the present invention, there is provided pumped drainage apparatus for a shower, the apparatus comprising a waste water unit having a waste water inlet for accepting waste water runoff from a shower, and a waste water outlet in fluid communication with the waste water inlet; a pump in fluid communication with the waste water unit; a sensing circuit including one or more sensors for sensing waste water and isolated to prevent in use contact with the waste water; and a control circuit for controlling and varying a flow rate of the pump based on an output of the sensing circuit.

Preferable and/or optional features of the first aspect of the invention are set forth in the claims.

According to a second aspect of the present invention, there is provided a variable flow control device for pumped drainage apparatus of a shower, the device comprising a sensing circuit which includes one or more sensors for sensing waste water in the pumped drainage apparatus; and a control circuit for controlling and varying a flow rate of a pump of the pumped drainage apparatus in relationship to an amount of waste water sensed.

Preferable and/or optional features of the second aspect of the invention are set forth in the claims.

BRIEF DESCRIPTION OF THE DRAWINGS

The invention will now be more particularly described, by way of example only, with reference to the accompanying drawings, in which.

DETAILED DESCRIPTION OF THE INVENTION

Figure 1:
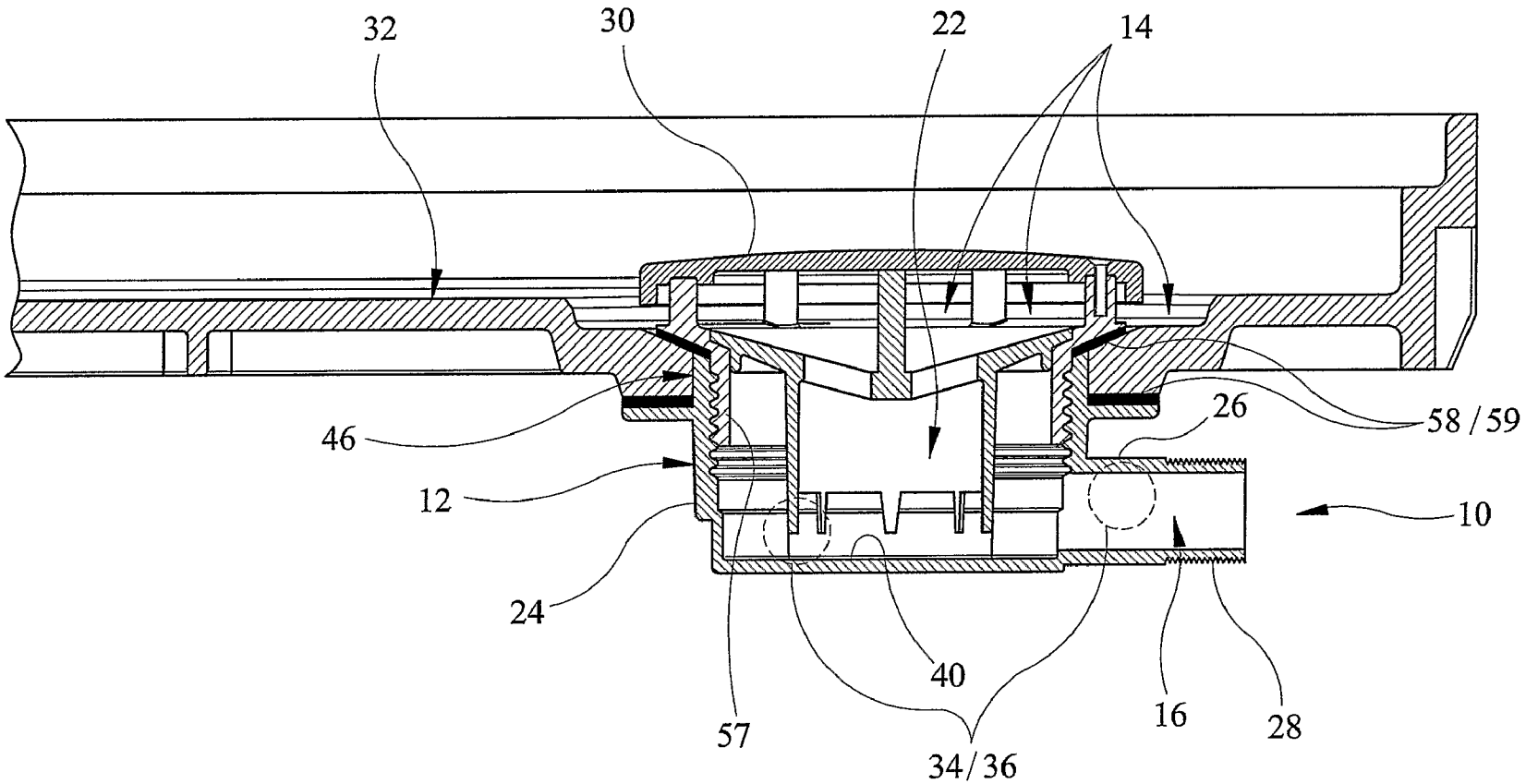
FIG. 1 is a side sectional view of part of a first embodiment of pumped drainage apparatus, in accordance with the first aspect of the invention, and part of a first embodiment of a variable flow control device, in accordance with the second aspect of the invention.

Referring firstly to FIGS. 1 to 4, 7, 11 and 12, pumped drainage apparatus 10 comprises a waste water unit 12 having a waste water inlet 14 and a waste water outlet 16 in fluid communication with the waste water inlet 14, a discharge conduit 18 connected at one end to the waste water outlet 16, and a pump 20 connected to another end of the discharge conduit 18. Obviously, however, other traditional or standard conduits or pipework can be interposed between the waste water unit 12, the pump 20 and the discharge conduit 18, as necessity dictates.

Although the waste water unit 12 as shown does not include a trap, any suitable type of waste water unit, dependent upon the available installation depth, can be utilised.

The waste water unit 12 in FIG. 1 includes a cavity 22 formed in a base 24 of the waste water unit 12 into which waste water passing through the waste water inlet 14 flows. The waste water outlet 16 is provided in one side of the cavity 22, and includes a short outlet conduit 26 with a coupling mechanism 28, for example a known speed fit or push fit coupling, for coupling to standard pipework and/or the discharge conduit 18.

Figure 11:
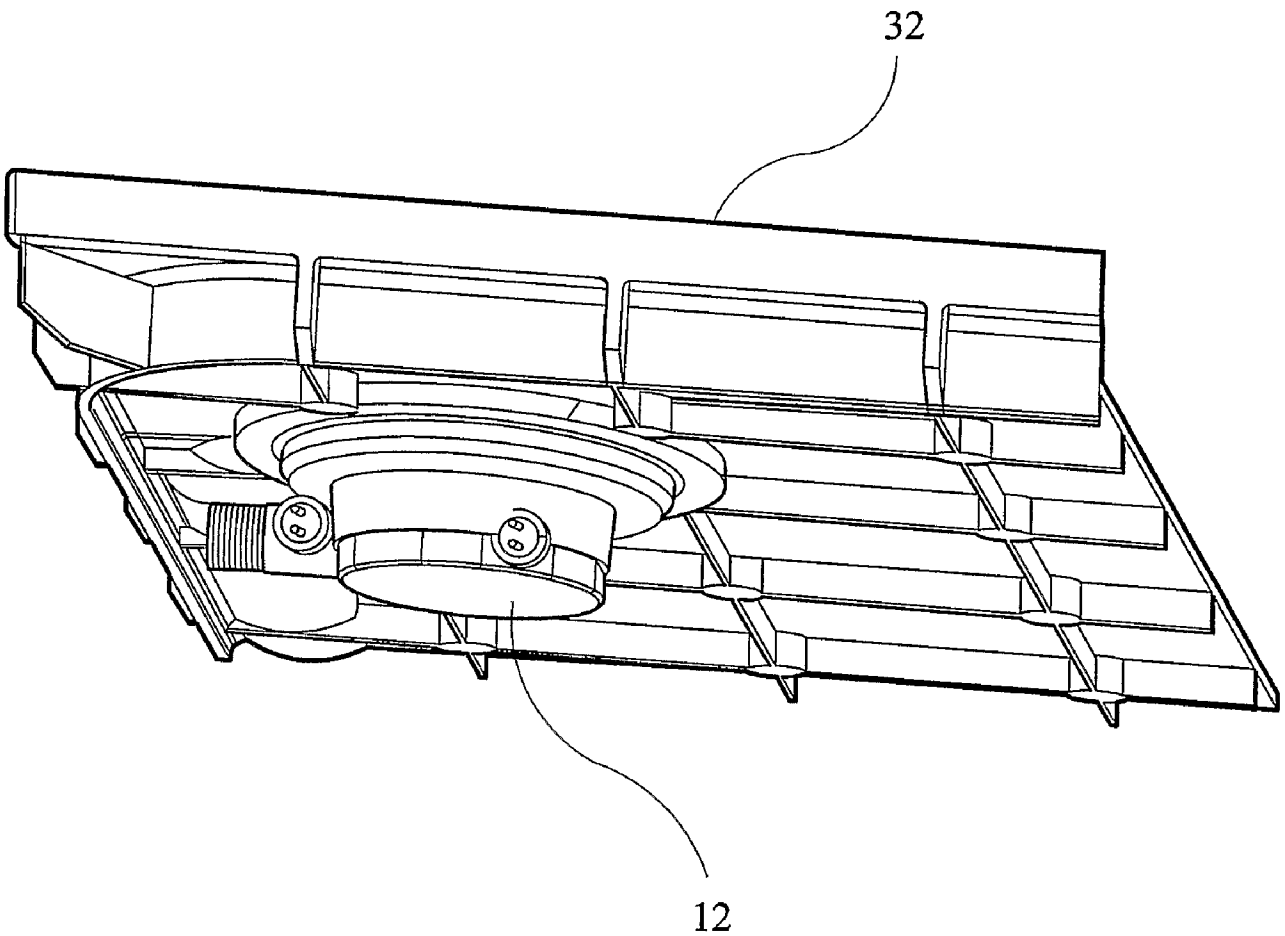
FIG. 11 is a perspective view from below of a waste water unit shown in FIG. 1 connected to a shower tray or shower floor material.
Figure 12:
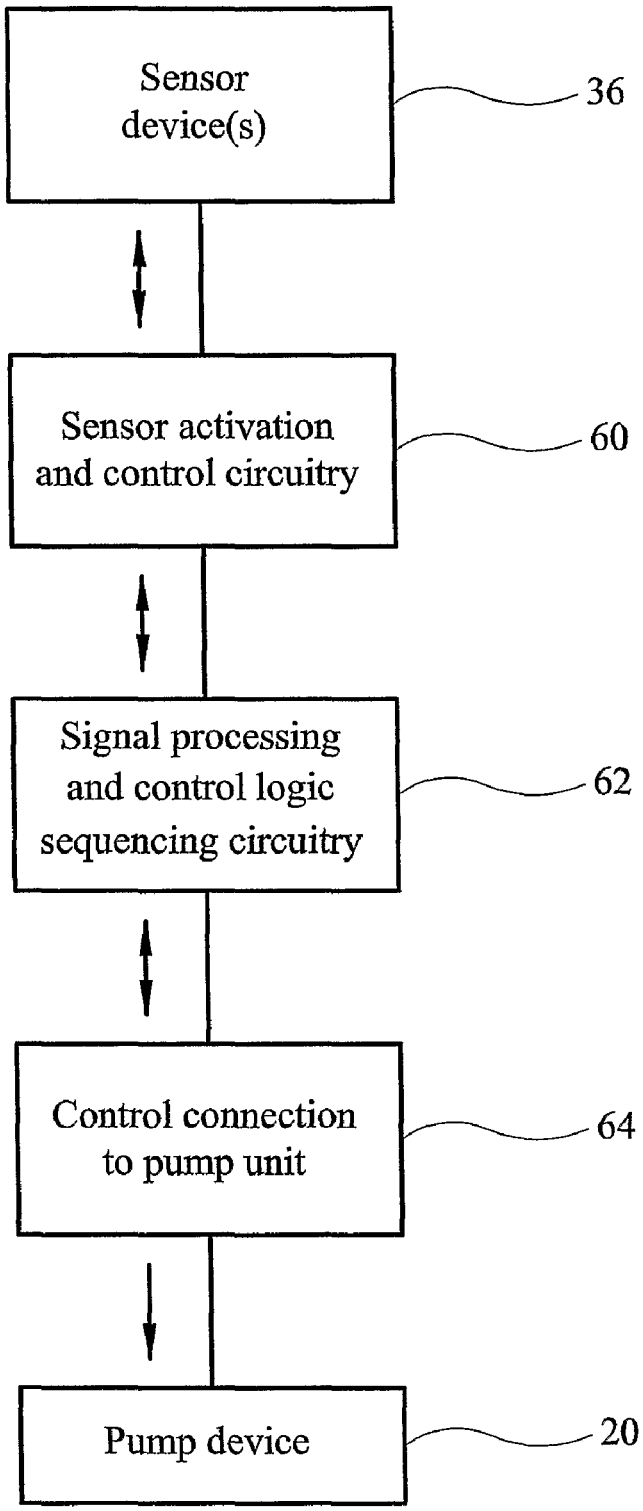
FIG. 12 is a flow chart of sensing and control circuits, in accordance with the first and second aspects of the invention.

The waste water unit 12 also includes a removable cover 30 which is adapted to define, at least in part, the waste water inlet 14, and which may include a clamp ring arrangement 57 for clamping the base 24 of the waste water unit 12 to a shower tray or shower floor material 32 utilising sealing elements 58,59, see FIGS. 1 and 11. The cover 30 is releasably secured to the base 24 of the waste water unit 12 in any suitable fashion, such as snap fit, twist fit or by the use of threaded fasteners.

The pumped drainage apparatus 10 includes a variable flow control device 34 which comprises a sensing circuit 60 having a plurality of ultrasonic sensors 36, and a control circuit 62 which is connected to the sensing circuit 60 and the pump 20. Two of the sensors 36 are provided on the waste water unit 12, as shown in FIGS. 1 to 4. A first one of the sensors 36 is provided in a first recess 38 formed in an external surface of the side of the base 24 of the waste water unit 12, adjacent to a bottom surface 40 of the waste water unit 12. The first recess 38 projects into the cavity 22 and isolates the sensor 36 from contact with any waste water.

A second one of the sensors 36 is provided in a second recess 42 formed in an external surface of the side of the outlet conduit 26 of the waste water outlet 16. Similarly to the first recess 38, the second recess 42 also isolates the sensor 36 from contact with any waste water.

Figure 2:
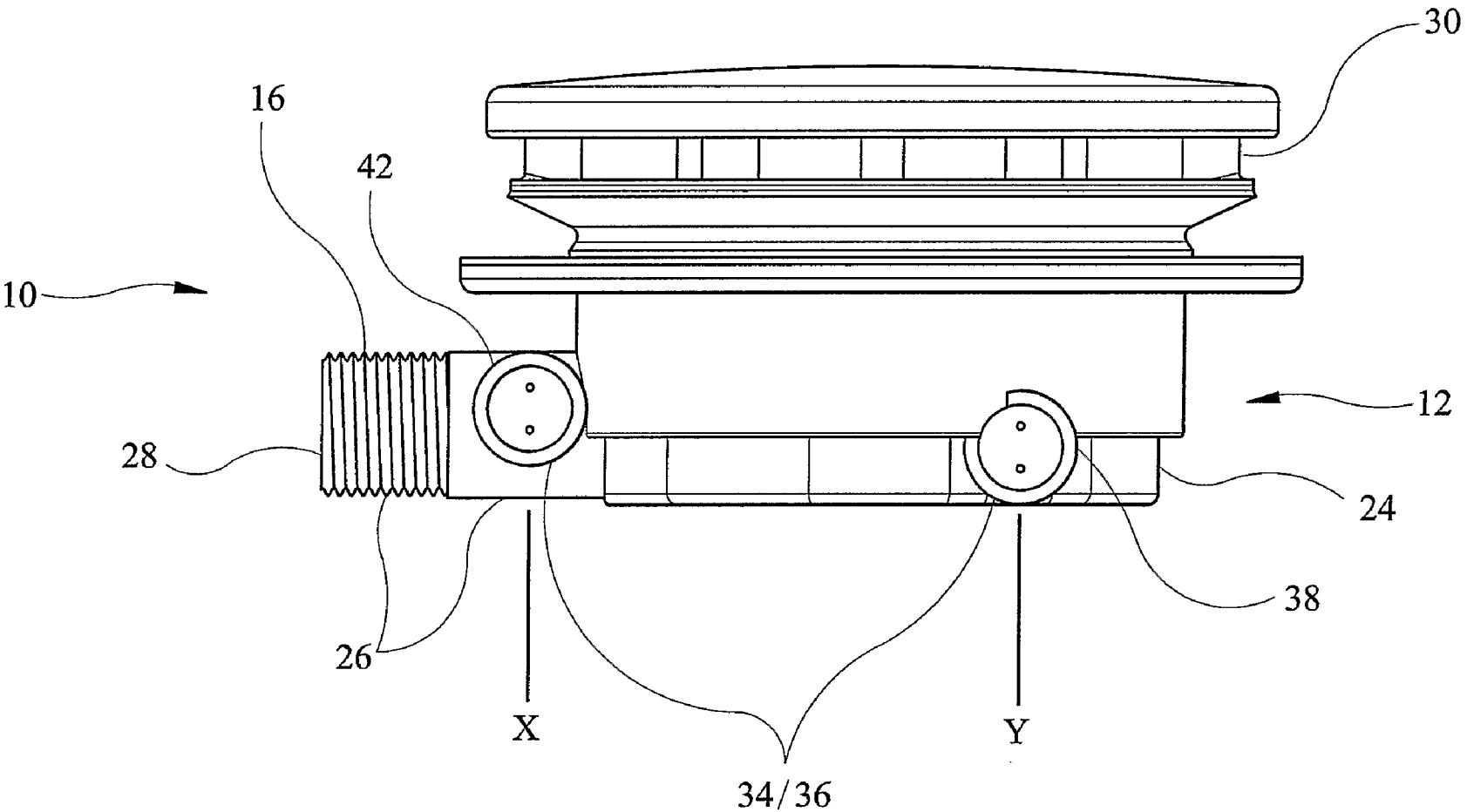
FIG. 2 is a side view of the pumped drainage apparatus and variable flow control device shown in FIG. 1.
Figure 4:
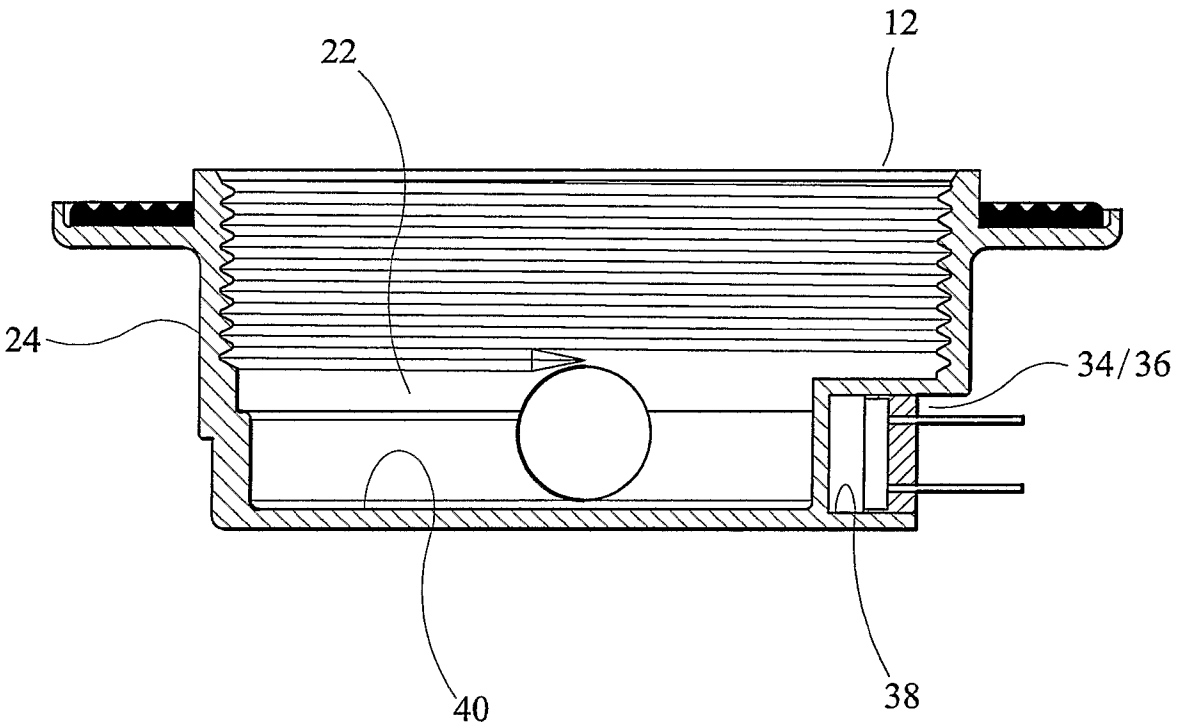
FIG. 4 is a lateral cross-section of the waste water unit shown in FIG. 2, taken on line Y and with cover removed.
Figure 3:
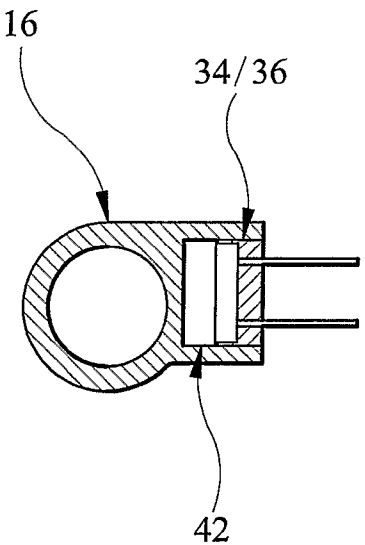
FIG. 3 is a lateral cross-section of a waste water outlet of a waste water unit shown in FIG. 2, taken on line X.

As can be appreciated from FIGS. 1 and 2, the first and second recesses 38 and 42 are positioned at different heights from the bottom surface 40 of the waste water unit 12, the reason for which will become apparent hereinafter.

Figure 7:
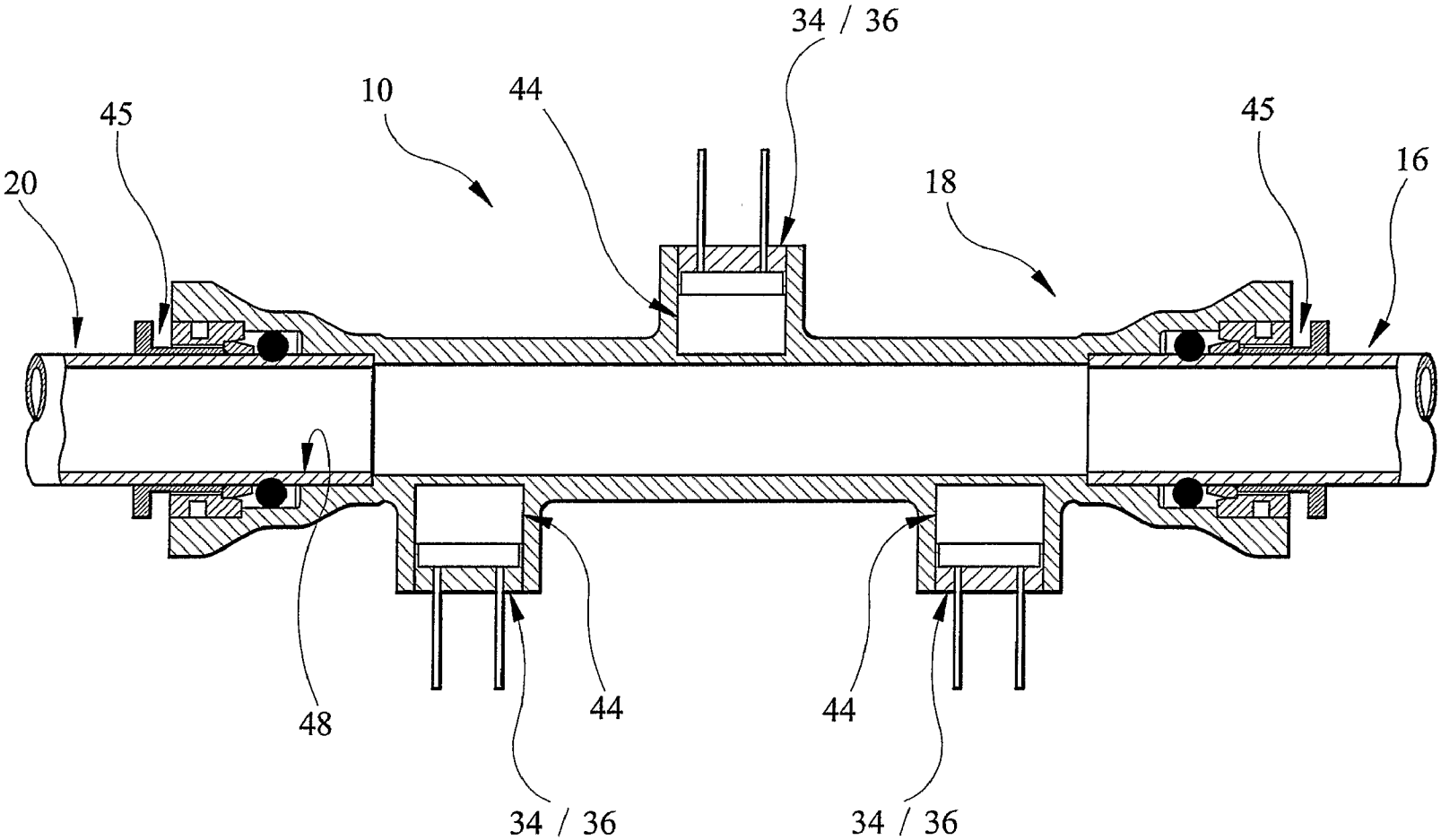
FIG. 7 is a longitudinal sectional view of a discharge conduit of the first embodiment of the pumped drainage apparatus, in accordance with the first aspect of the invention, and of the first embodiment of the variable flow control device, in accordance with the second aspect of the invention.

As shown in FIG. 7, three more of the sensors 36 are provided in spaced relationship along the longitudinal extent of the discharge conduit 18. The sensors 36 are located in third recesses 44, again formed in an external surface of a side of the discharge conduit 18 so as to isolate the sensors 36 from contact with any waste water.

Although not shown, further sensors could be provided not only in longitudinally spaced relationship on the discharge conduit 18, but also in circumferentially spaced relative relationship.

Each end of the discharge conduit 18 includes a coupling mechanism 45, for example being the known threaded, speed fit or push fit coupling.

Each sensor 36 is provided in a respective recess 38, 42, 44 preferably as a releasable push fit. However, the sensors 36 may be permanently located.

The pumped drainage apparatus 10 is installed similarly to standard pumped drainage apparatus. The waste water unit 12 is engaged with a waste water aperture 46 in the shower tray or shower floor material 32, for example via the aforementioned clamp ring arrangement. The pump 20 is located and the outlet is connected to a drain pipe (not shown), inlet 48 (see FIG. 7) is connected to the discharge conduit 18, which in turn is connected to the waste water outlet 16 of the waste water unit 12.

Each of the sensors 36 is connected to the sensing circuit 60, which outputs signal information to the control circuit 62. The sensing circuit 60 and the control circuit 62 are entirely external of the waste water unit 12 and discharge conduit 18, and are thus also entirely isolated from contact with any waste water.

In use, the sensing circuit 60 of the variable flow control device 34 monitors the presence and amount of water in the pumped drainage apparatus 10. As waste water flows through the waste water inlet 14 and into the cavity 22 of the waste water unit 12, the sensor 36 in the first recess 38 adjacent to the bottom surface 40 of the base 24 of the waste water unit 12 senses the presence of water and outputs a first signal. Since the sensor 36 is ultrasonic, this signal changes dependent on the volume of water and air present.

Once a signal is outputted from the sensor 36 in the cavity 22, the control circuit 62 operates the pump 20 via control connection 64 based on an appropriate command derived from the sensing circuit 60. This command is dependent on the volume of water and air sensed by the sensor 36. If the volume of waste water is low, the command results in the control circuit 62 ramping up the operation of the pump 20 until a relatively low flow rate is achieved. Consequently, less noise is emitted from the pump 20. If the volume of waste water detected is high, the command results in the control circuit 62 ramping up the operation of the pump 20 more quickly until a relatively high flow rate is achieved. Continuous monitoring by the sensor 36 on the base 24 of the waste water unit 12 allows continuous feedback control of the pump 20 via the sensing circuit 60 and the control circuit 64.

The sensor 36 located in the second recess 42 on the outlet conduit 26 of the waste water unit 12 and those along the discharge conduit 18 are utilised to determine the volume of water and air present in the pumped drainage apparatus 10 and the flow rate therealong. The sensor 36 located on the outlet conduit 26 of the waste water unit 12 is above the sensor 36 located on the base 24 of the waste water unit 12, and thus the flow rate of water entering the waste unit can be correlated by the sensing circuit 60 and a suitable command determined by the control circuit 62 for optimising the speed of operation of the pump 20.

By axially spacing the sensors 36 on the discharge conduit 18, again the flow rate of water passing through the discharge conduit 18 can be determined by the sensing circuit 60, and the control circuit 62 can thus optimise pump operation.

Furthermore, by circumferentially spacing the sensors 36 around the discharge conduit 18, the volume of water passing through the discharge conduit 18 can be determined, allowing further optimisation.

Backflow is also monitored by utilising at least two of the sensors 36 due to their spaced relationship. If a typically downstream sensor 36, for example in the discharge conduit 18, senses water before a typically upstream sensor 36, for example in the waste water unit 12, then the sensing circuit 60 determines that a backflow condition is present and outputs a command to the control circuit 62 causing the pump 20 to activate and reverse the backflow. The flow rate of the pump 20 is again determined based on the volume of water sensed by the plurality of sensors 36.

Figures 5A, 5B:
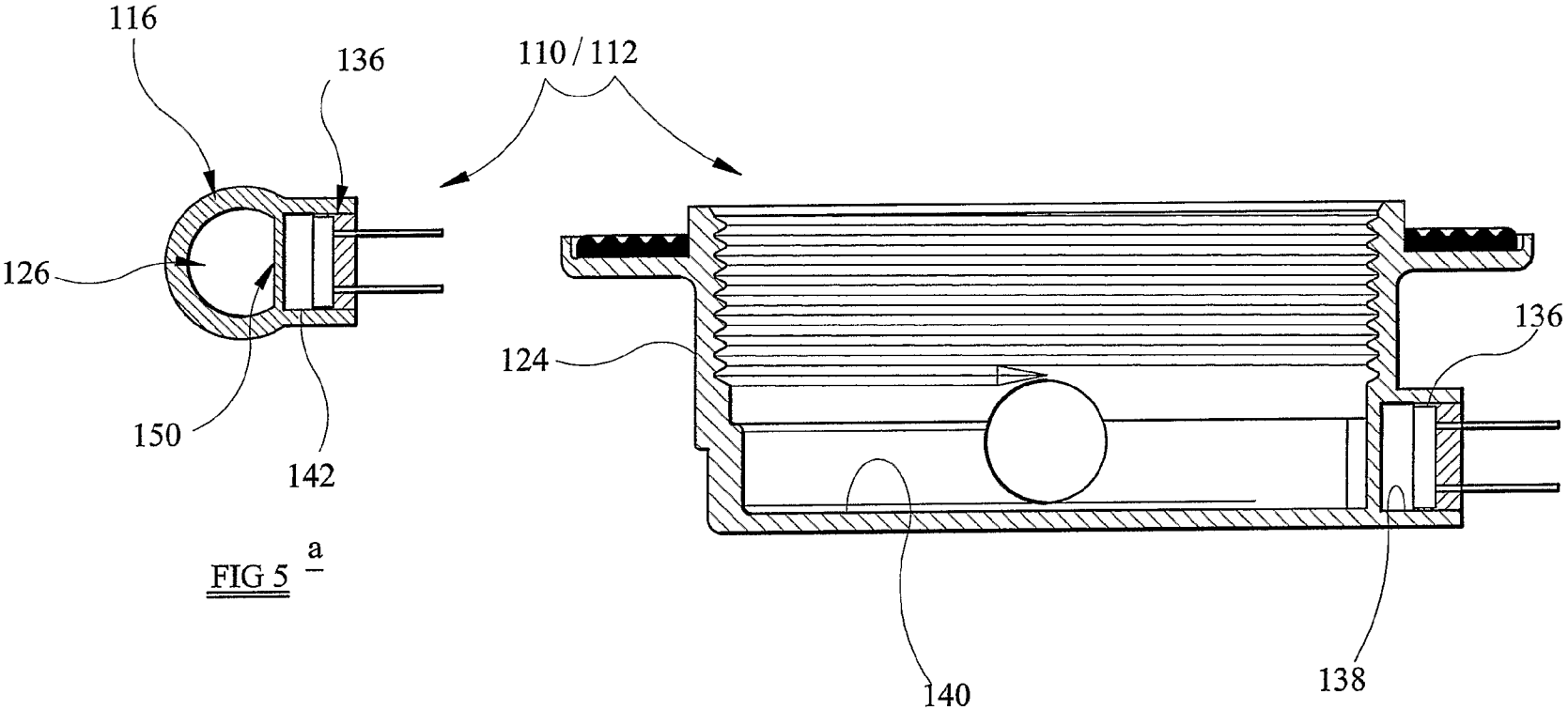
FIGS. 5*a* and 5*b* are lateral cross-sections similar to FIGS. 3 and 4, respectively, showing second embodiments of parts of the pumped drainage apparatus and the variable flow control device.

FIGS. 5*a* and 5*b* show a waste water outlet 116 and a waste water base 124, respectively, of part of a second embodiment of pumped drainage apparatus 110. In this embodiment, references which are similar to those of the first embodiment refer to like parts, and further detailed description is omitted. Furthermore, a variable flow control device 134 of the second embodiment corresponds to that of the first embodiment.

The second embodiment differs from the first embodiment in that first, second and third recesses 138, 142 used to house sensors 136 of sensing circuit are repositioned. The outlet conduit 126 of a waste water outlet 116 of a waste water unit 112 has a non-circular lateral interior cross-section. In particular, an interior surface 150 adjacent to the or each sensor 136 is flattened to promote more accurate determination of fluid volume.

First recess 138 adjacent to bottom surface 140 of the base 124 of the waste water unit 112 is formed in a housing which projects unitarily outwardly from a side of the base 124.

Figures 6A, 6B:
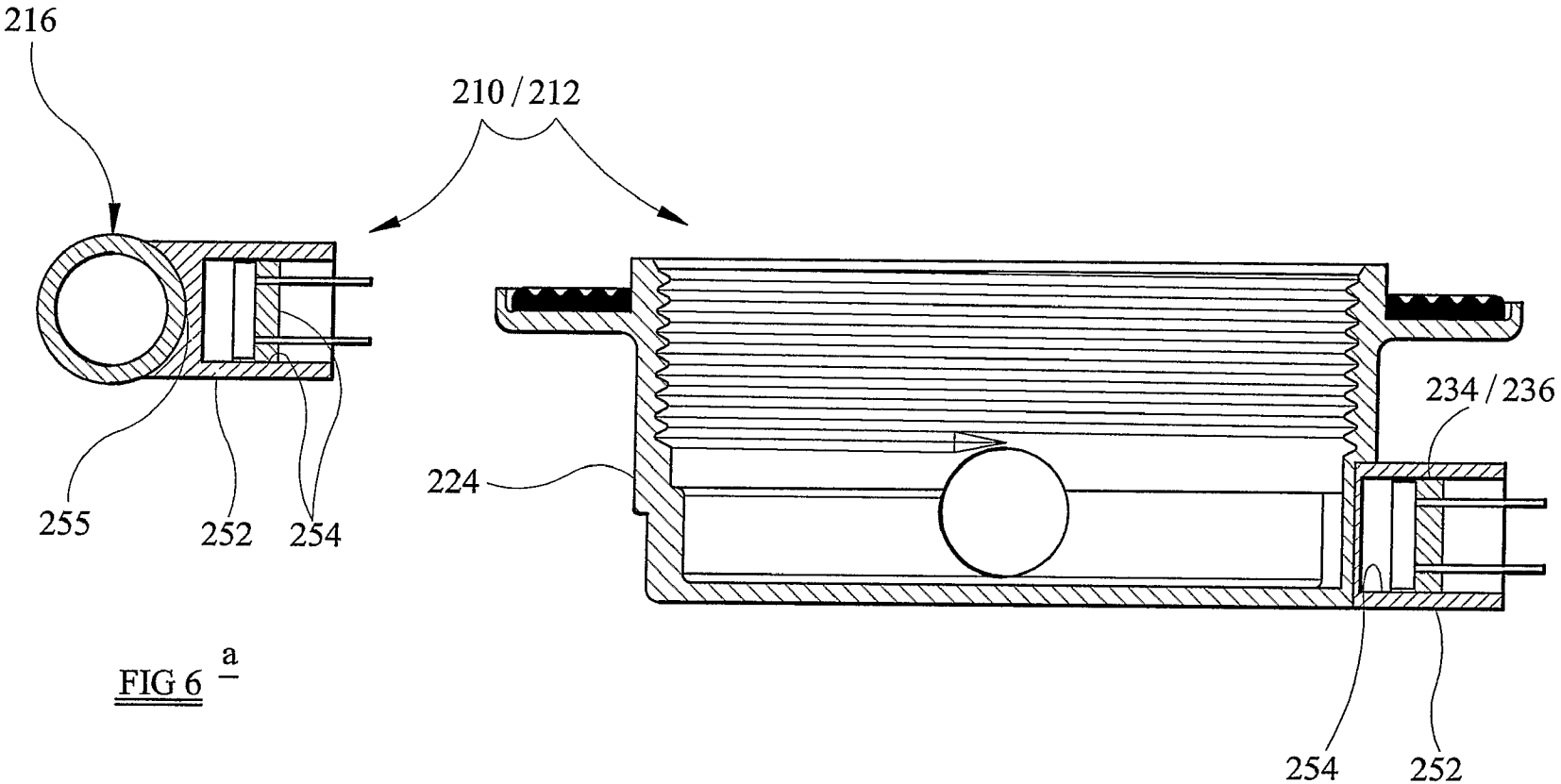
FIGS. 6*a* and 6*b* are lateral cross-sections similar to FIGS. 3 and 4, respectively, showing third embodiments of parts of the pumped drainage apparatus and the variable flow control device.

FIGS. 6*a* and 6*b* show a waste water outlet 216 and a waste water base 224, respectively, of part of a third embodiment of pumped drainage apparatus 210. References which are similar to those of the first embodiment refer to like parts, and further detailed description is omitted. Furthermore, variable flow control device 234 of the third embodiment substantially corresponds to that of the second embodiment.

In this embodiment, specific housings 252 are provided having recesses 254 in which the sensors 236 are positionable. Each housing 252 is independent of the waste water unit 212 and discharge conduit, and can thus be attached and detached as necessity dictates, without necessarily having to remove any other part of pre-existing pumped drainage apparatus 210.

The discharge conduit can thus be formed from standard or traditional pipework 256 to which a housing 252 with a sensor 236 is mounted. Similarly, one or more housings 252 with sensors 236 is/are attached to a standard or traditional waste water unit 212 to provide monitoring of waste water flowing into the waste water unit 212.

In this case, control circuit of the variable flow control device 234 is wired into circuitry of an existing electric pump (not shown), and sensing circuit provides commands from the sensors 236 in the housings 252 as described above.

Figure 8:
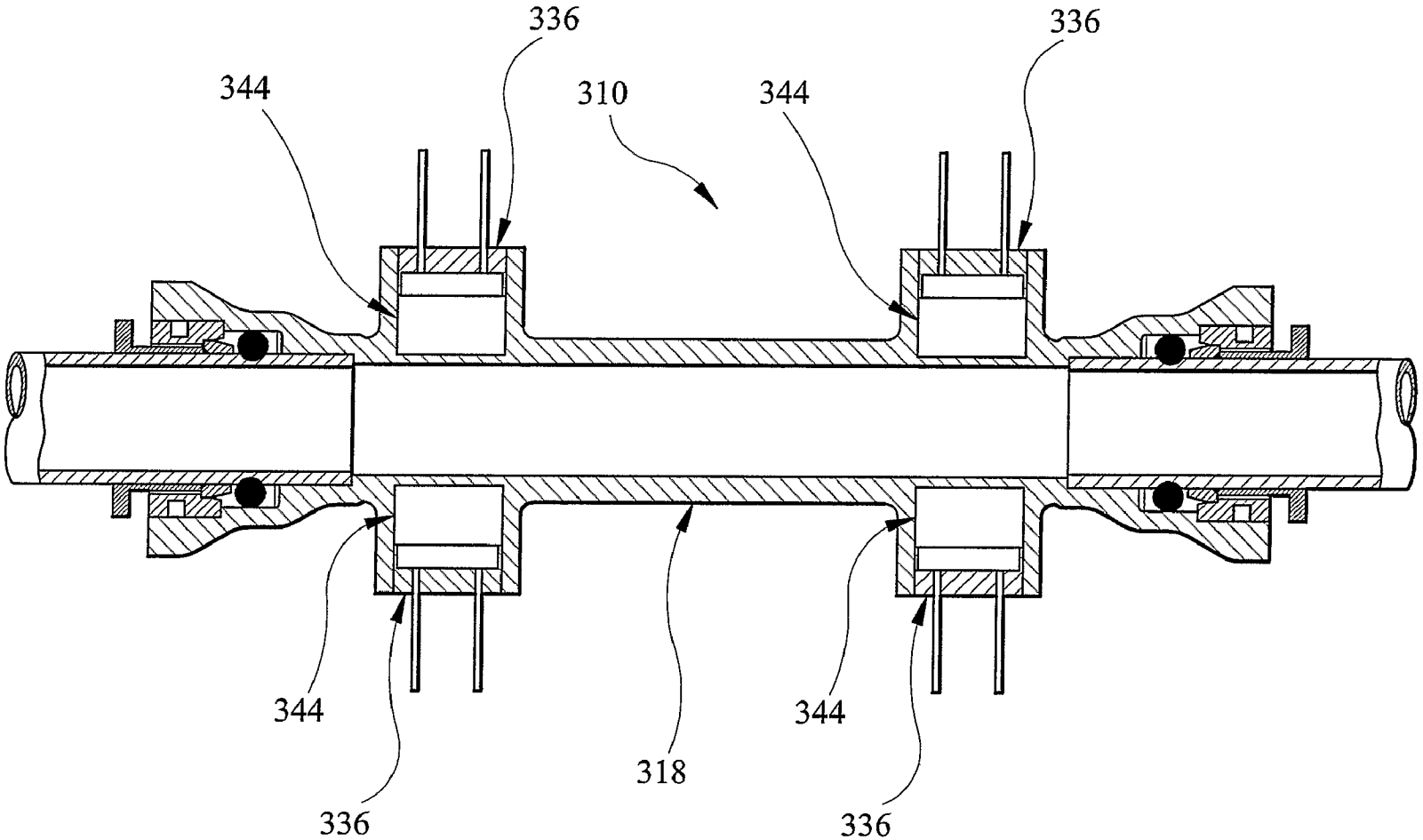
FIG. 8 is a longitudinal sectional view of a discharge conduit of a fourth embodiment of the pumped drainage apparatus, in accordance with the first aspect of the invention, and of a fourth embodiment of the variable flow control device, in accordance with the second aspect of the invention.

Referring to FIG. 8, there is shown a discharge conduit 318 of a fourth embodiment of pumped drainage apparatus 310. In this embodiment, the sensors 336 are mounted in third recesses 344 integrally formed on an exterior surface of the discharge conduit 318, similarly to the first embodiment. However, in this case, two pairs of the third recesses 344 are provided, and each third recess 344 in each pair is positioned to face the other third recess 344. This increases the sensitivity of the detection of waste water in the discharge conduit 318.

It is also possible to provide more than two third recesses which are circumferentially aligned. The arrangement of circumferentially aligned third recesses may be diametrically opposite, in the case of two third recesses, or equiangularly spaced in the case of more than two third recesses.

Although the third recesses can be axially and circumferentially spaced from each other, any combination of the previously described arrangements can be utilised.

Figure 9:
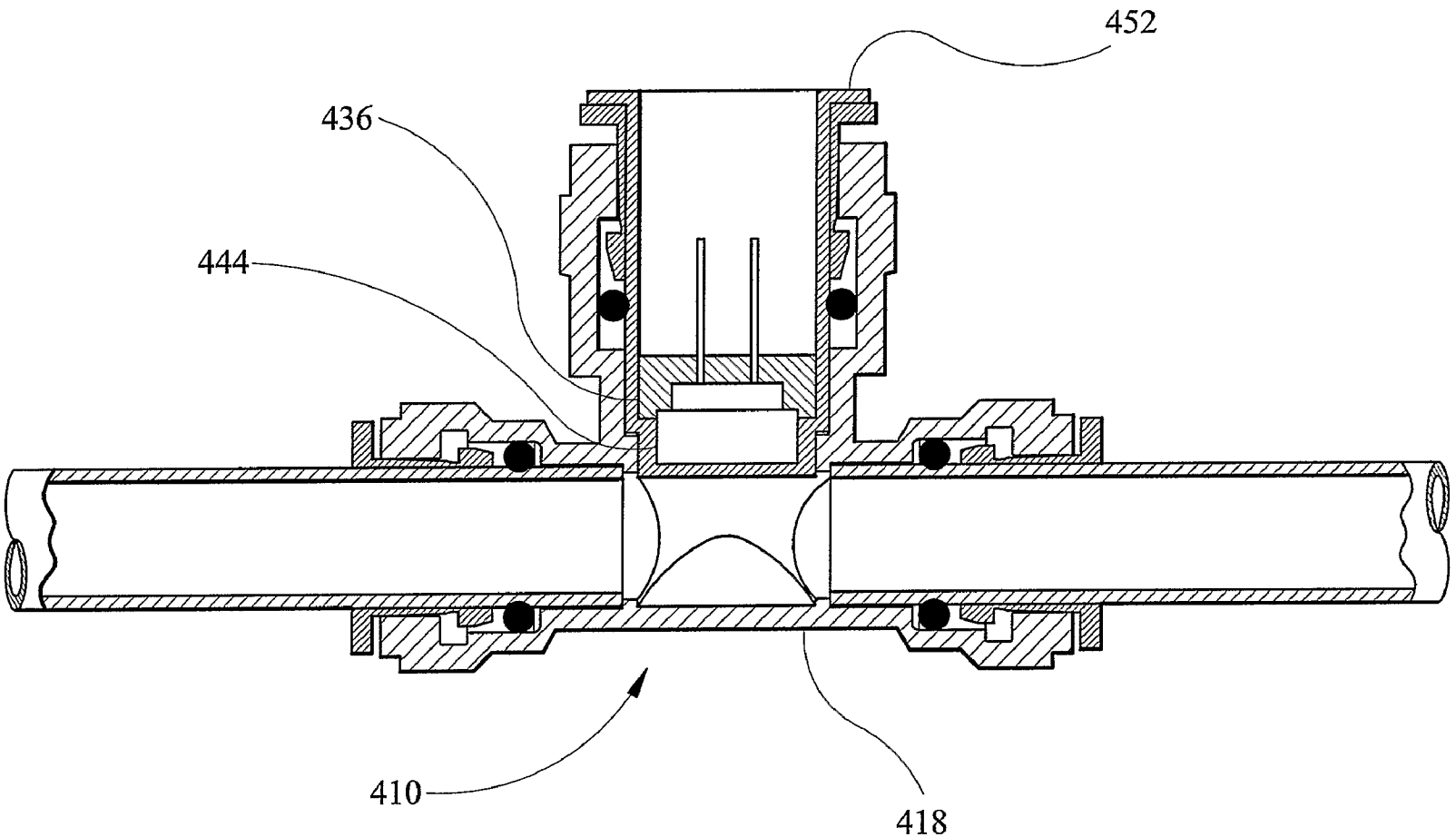
FIG. 9 is a longitudinal sectional view of a discharge conduit of a fifth embodiment of the pumped drainage apparatus, in accordance with the first aspect of the invention, and of a fifth embodiment of the variable flow control device, in accordance with the second aspect of the invention.

Referring to FIG. 9, there is shown a discharge conduit 418 of a fifth embodiment of pumped drainage apparatus 410. Again, like references refer to like parts. Only a single recess 444 is shown, which takes the form of a conduit of a conventional T-piece plumbing fitting. Sensor 436 is provided in a specific independent, typically injection moulded, housing 452, which is then located liquid-tightly in the recess 444. Due to the conventional T-fitting having a conventional coupling, releasably secure location of the housing 452 is simple.

Due to the housing 452, the sensor 436 remains isolated from the fluid flow in the discharge conduit 418.

Although the sensors described above are ultrasonic sensors and are isolated from the fluid flow, the sensors could project into the fluid flow, and thus be in direct contact with the fluid in the pumped drainage apparatus.

Figure 10:
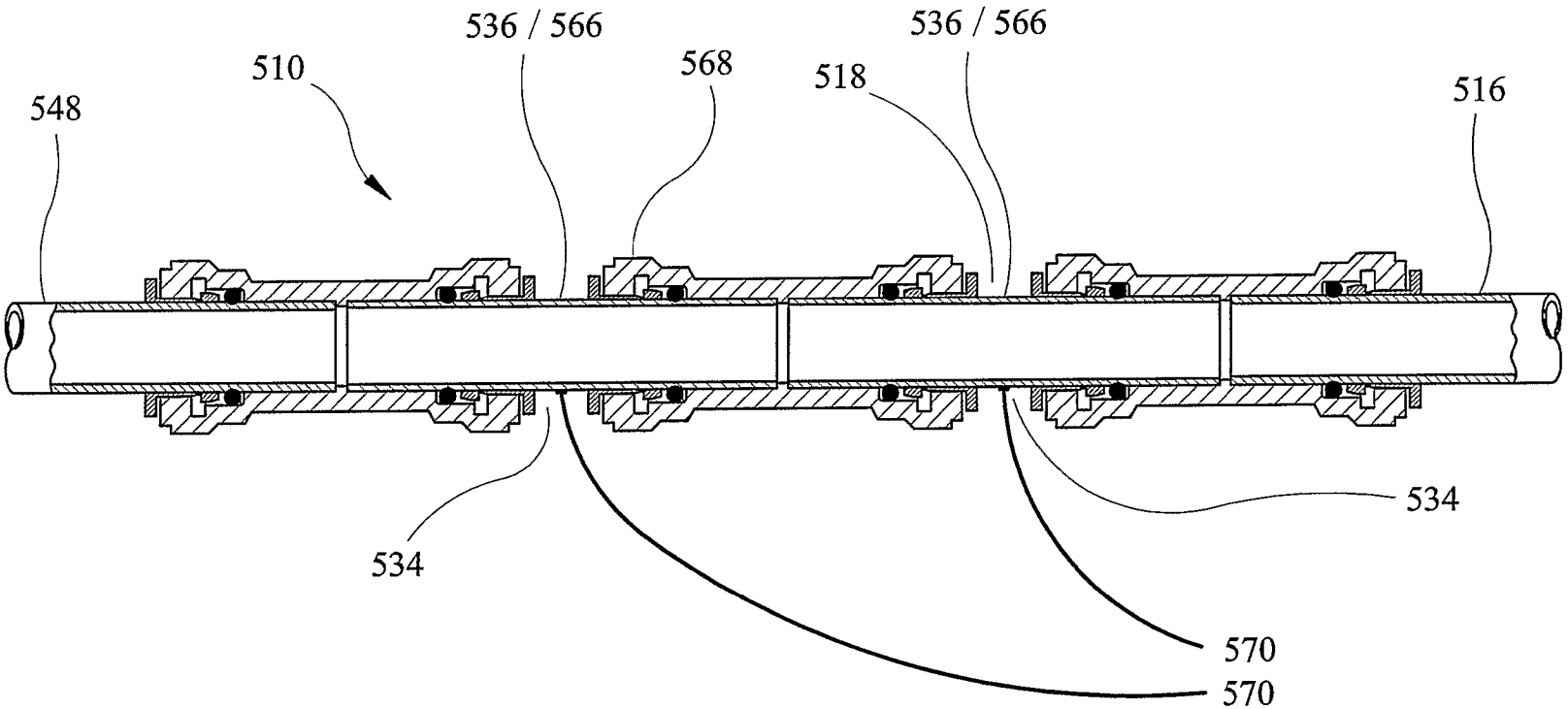
FIG. 10 is a longitudinal sectional view of a discharge conduit of a sixth embodiment of the pumped drainage apparatus, in accordance with the first aspect of the invention, and of a sixth embodiment of the variable flow control device, in accordance with the second aspect of the invention.

Referring to FIG. 10, there is shown a discharge conduit 518 of a sixth embodiment of pumped drainage apparatus 510. Like references refer to like parts, and further detailed description is omitted.

The discharge conduit 518 is provided with two spaced conductive pipe elements 566 interconnected by coupling element 568. One end of the discharge conduit 518 fluidly communicates with waste water outlet 516 of a waste water unit, as described above, and the other end fluidly communicates with pump inlet 548.

A sensing circuit of variable flow control device 534 comprises sensors 536. In this embodiment, the sensors 536 are capacitative and are formed by the spaced conductive pipe elements 566. Each pipe element 566 is connected to circuitry of the sensing circuit via wires 570.

In this embodiment, the sensors 536 are in direct contact with the fluid flow in the discharge conduit 518. In use, the sensing circuit energises the sensors 536 which provide feedback concerning the amount of water in the discharge conduit 518 due to their changing capacitance.

One or more protective covers (not shown) can also be provided to help protect the wires 570 and their connections to the pipe elements 566. The or each cover also acts to prevent undesirable contact of the pipe elements 568 by an external item which may result in spurious and incorrect information being outputted from the sensors 536.

Capacitative sensors can also be used in a waste water unit.

More than two sensors can also be provided on the waste water unit.

In each case, the, each or at least one ultrasonic sensor can be a single transceiver, or groups of sensors can be provided with one sensor operating as a transmitter and one or more sensors operating as receivers.

Preferably, a plurality of ultrasonic sensors are provided. However, basic waste water volume detection can be undertaken with as few as one external sensor provided on the waste water unit and/or the discharge conduit. In this case, the other sensors and/or recesses can be dispensed with.

It is intended that ultrasonic sensors are preferably utilised. However, any suitable type of sensor, or combination of sensors, can be used, either being in direct contact with fluid flow in the pumped drainage apparatus, or isolated from the fluid flow.

The pumped drainage apparatus and/or variable flow control device can be provided as a kit of parts, simplifying assembly and installation. If the variable flow control device is provide for retrospective fitting on existing pumped drainage apparatus, the discharge tube can be optionally included. Additionally, or alternatively, the waste water unit can be optionally included.

By providing a variable flow control device for a pumped drainage apparatus, pump operation can always occur at an optimum level, instead of simply being on or off as is presently the case. The variable flow control device permits ramping up and ramping down the operation of the pump, providing less intrusive and noticeable noise, and by only operating the pump at a required flow rate, undesirable noise can be markedly reduced. The use of ultrasonic sensors prevents interference and incorrect readings from the presence of detritus and other particulate waste matter. It is also possible to retrospectively fit a variable flow control device to existing pumped drainage apparatus to provide the aforementioned beneficial effects.

The embodiments described above are given by way of examples only, and various other modifications will be apparent to persons skilled in the art without departing from the scope of the invention as defined by the appended claims.

The invention claimed is:

1. A pumped drainage apparatus for a shower, the apparatus comprising:

a waste water unit having a waste water inlet which accepts waste water runoff from a shower, and a waste water outlet in fluid communication with the waste water inlet;

a pump in fluid communication with the waste water unit;

a sensing circuit including at least one sensor which continually senses a volume of waste water, wherein the at least one sensor is an ultrasonic sensor provided in a recess in an exterior surface of the waste water unit, whereby each of said at least one sensor is isolated to prevent in use contact with the waste water;

a control circuit which controls and continually optimizes a flow rate of the pump based only on the volume of waste water sensed by the sensing circuit; and wherein a discharge conduit is connected to the waste water unit and to the pump.

2. The pumped drainage apparatus as claimed in claim 1, having a plurality of sensors, each sensor on the waste water unit positioned at a height relative to a bottom surface of the waste water unit, the height being different to a height at which other sensors of the plurality of sensors are positioned.

3. The pumped drainage apparatus as claimed in claim 1, wherein the pump fluidly communicates with the waste water outlet of the waste water unit via the discharge conduit, the at least one sensor being provided on or adjacent to a surface of the discharge conduit.

4. The pumped drainage apparatus as claimed in claim 3, wherein the discharge conduit includes a recess in an exterior surface, the at least one sensor located in the recess.

5. A variable flow control device for a pumped drainage apparatus of a shower, the device comprising:

a sensing circuit which includes at least one sensor which continually senses a volume of waste water in the pumped drainage apparatus, wherein the at least one sensor is an ultrasonic sensor provided in a recess in an exterior surface of a waste water unit of the apparatus, whereby the at least one sensor is isolated to prevent in use contact with the waste water, and wherein each of said at least one sensor is operative to independently indicate a volume of waste water;

a control circuit which controls and continually optimizes a flow rate of a pump of the pumped drainage apparatus based only on the volume of waste water sensed by the sensing circuit; and wherein a discharge conduit is in fluid communication with the waste water unit.

6. A variable flow control device as claimed in claim 5, wherein the waste water unit of the apparatus has a waste water inlet which accepts waste water runoff from a shower, and a waste water outlet in fluid communication with the waste water inlet.

7. A variable flow control device as claimed in claim 5, having a plurality of waste water unit recesses, each recess of the plurality of recesses positioned at a different height from a base of the waste water unit.

8. A variable flow control device as claimed in claim 5, wherein the discharge conduit is in fluid communication with the pump of the pumped drainage apparatus, and further comprising at least one additional sensor, wherein the sensor is located on or in the discharge conduit.

9. A variable flow control device as claimed in claim 8, wherein the discharge conduit includes a recess for holding the at least one additional sensor.

10. A variable flow control device as claimed in claim 9, wherein the discharge conduit further includes a plurality of recesses spaced circumferentially around and longitudinally along the discharge conduit.

* * * * *